United States Patent [19]

Bayless et al.

[11] 4,415,021

[45] Nov. 15, 1983

[54] POSITIONING A THIN WALL ROUND WRAPPER WITHIN A HEAVY WALL OUT-OF-ROUND SHELL OF A HEAT EXCHANGER

[75] Inventors: John R. Bayless; Homer G. Hargrove; Edwin G. Thompson, all of St. Petersburg, Fla.

[73] Assignee: Westinghouse Electric Corp., Pittsburgh, Pa.

[21] Appl. No.: 293,725

[22] Filed: Aug. 17, 1981

[51] Int. Cl.[3] ..... F28F 7/00

[52] U.S. Cl. ..... 165/76; 165/162; 29/157.3 R

[58] Field of Search ..... 165/162, 160, 76; 29/157.3 R; 122/32, 34

[56] References Cited

U.S. PATENT DOCUMENTS 3,906,905 9/1975 Andrieu ..... 122/34

*Primary Examiner*—William R. Cline
*Assistant Examiner*—John F. McNally
*Attorney, Agent, or Firm*—F. J. Baehr, Jr.

[57] ABSTRACT

A thin wall, generally round wrapper or liner is installed within a heavy wall, rolled heat exchanger shell which has greater out-of-round tolerances than the wrapper and the wrapper is maintained in its round state by utilizing a plurality of different types of jacks disposed adjacent the tube support plates disposed within the wrapper.

10 Claims, 14 Drawing Figures

FIG. 3
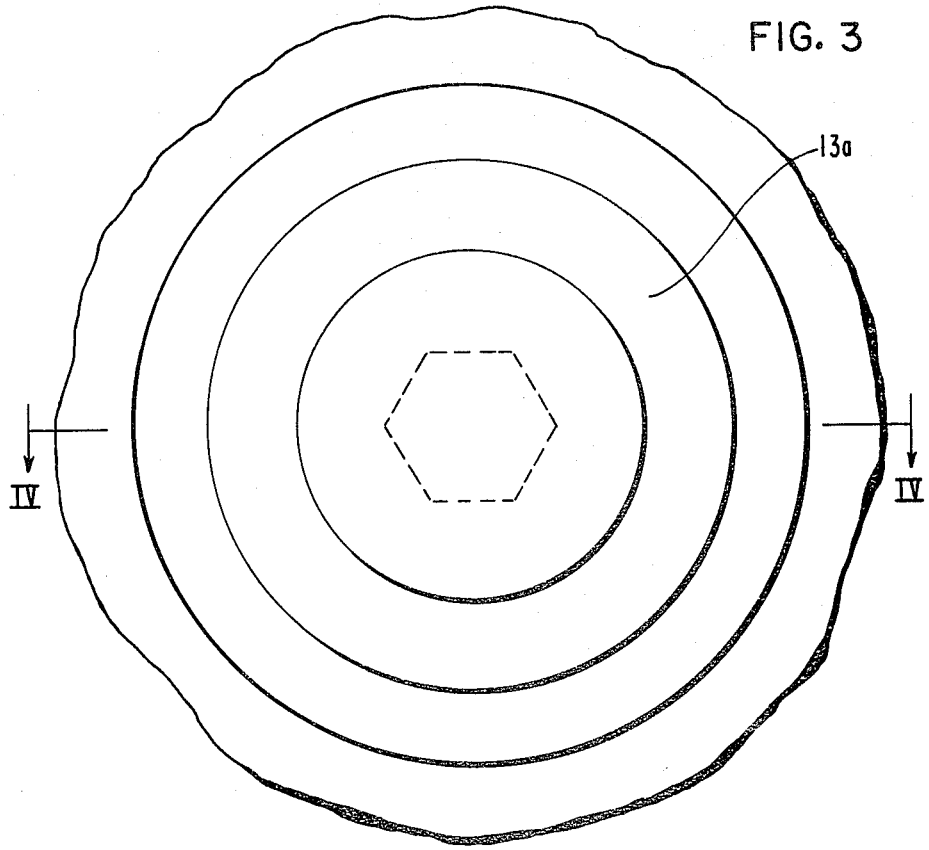
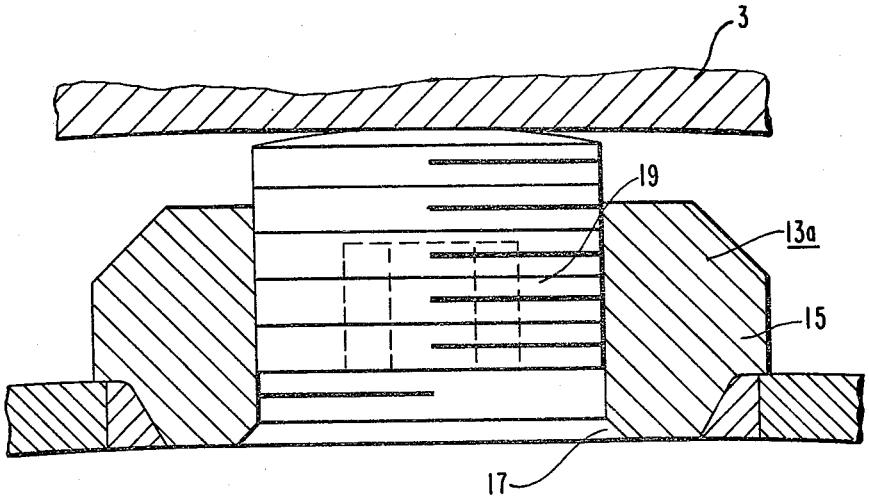
FIG. 4

FIG. 13
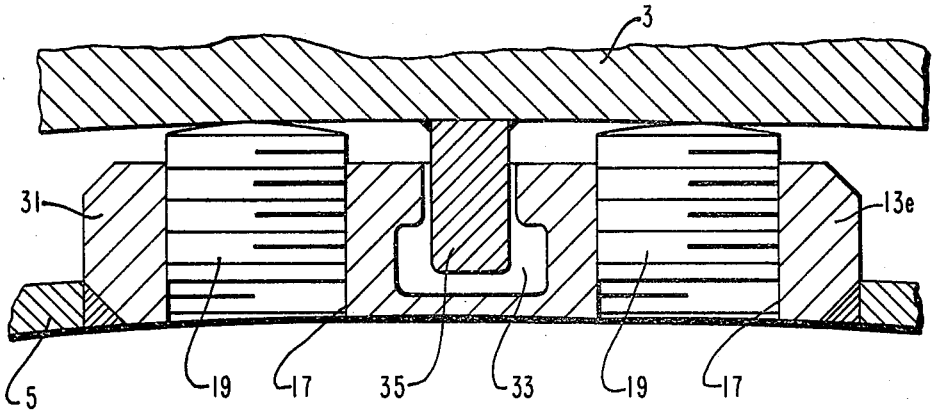
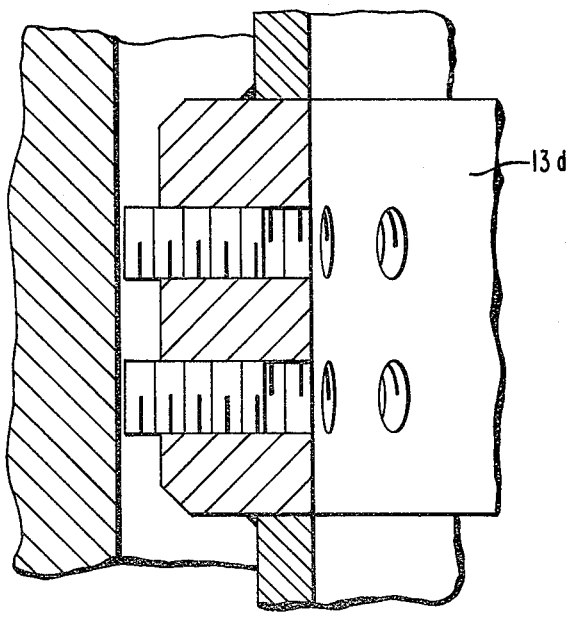
FIG. 14

POSITIONING A THIN WALL ROUND WRAPPER WITHIN A HEAVY WALL OUT-OF-ROUND SHELL OF A HEAT EXCHANGER

BACKGROUND OF THE INVENTION

This invention relates to heat exchangers and more particularly to the tube bundle wrapper of a nuclear steam generator.

Improving the roundness of the wrapper in a nuclear steam generator provides a solution to design and fabrication problems arising from tight assembly tolerances and tolerance stack-up. This provides a better structural load distribution within the steam generator to withstand seismic and other accident conditions for which the steam generator must be designed.

SUMMARY OF THE INVENTION

In general, a heat exchanger, when made in accordance with this invention, comprises a tubesheet with a plurality of holes for receiving tubes, a heavy wall rolled cylindrical shell portion, a thin wall round wrapper portion disposed within the shell portion and spaced therefrom, a plurality of generally parallel tube support plates longitudinally spaced within the wrapper portion and having a plurality of holes for receiving tubes and jacking members disposed circumferentially about the wrapper portion adjacent the location of the support plates. The jacking members extend radially outwardly from the wrapper portion into engagement with the shell portion. The heat exchanger also comprises a first array of lugs affixed to the shell portion, a first array of blocks affixed to the wrapper, the first array of lugs and blocks being cooperatively associated to prevent longitudinal movement of the wrapper with respect to the shell adjacent the first array of lugs. A second array of lugs affixed to the shell, a second array of blocks affixed to the wrapper, the second array of lugs and blocks being cooperatively associated to prevent rotation of the shell with respect to the wrapper adjacent the second array of lugs, wedges disposed between the wrapper and the support plates and means for preventing rotation of the tube support plates with respect to the wrapper whereby the holes in the tube support plates can be aligned with the holes in the tubesheet and the tube support plates can be accurately spaced within the wrapper portion to provide a controlled annular space therebetween.

BRIEF DESCRIPTION OF THE DRAWINGS

The objects and advantages of this invention will become more apparent from reading the following detailed description in conjunction with the accompanying drawings, in which:

FIG. 3 is an enlarged sectional view taken on line III—III of FIG. 2;

FIG. 4 is an enlarged sectional view taken on line IV—IV of FIG. 3;

FIG. 13 is an enlarged view of lugs and blocks shown in FIG. 10; and

FIG. 14 is an enlarged sectional view of a jacking ring.

DESCRIPTION OF THE PREFERRED EMBODIMENT

Figure 1:
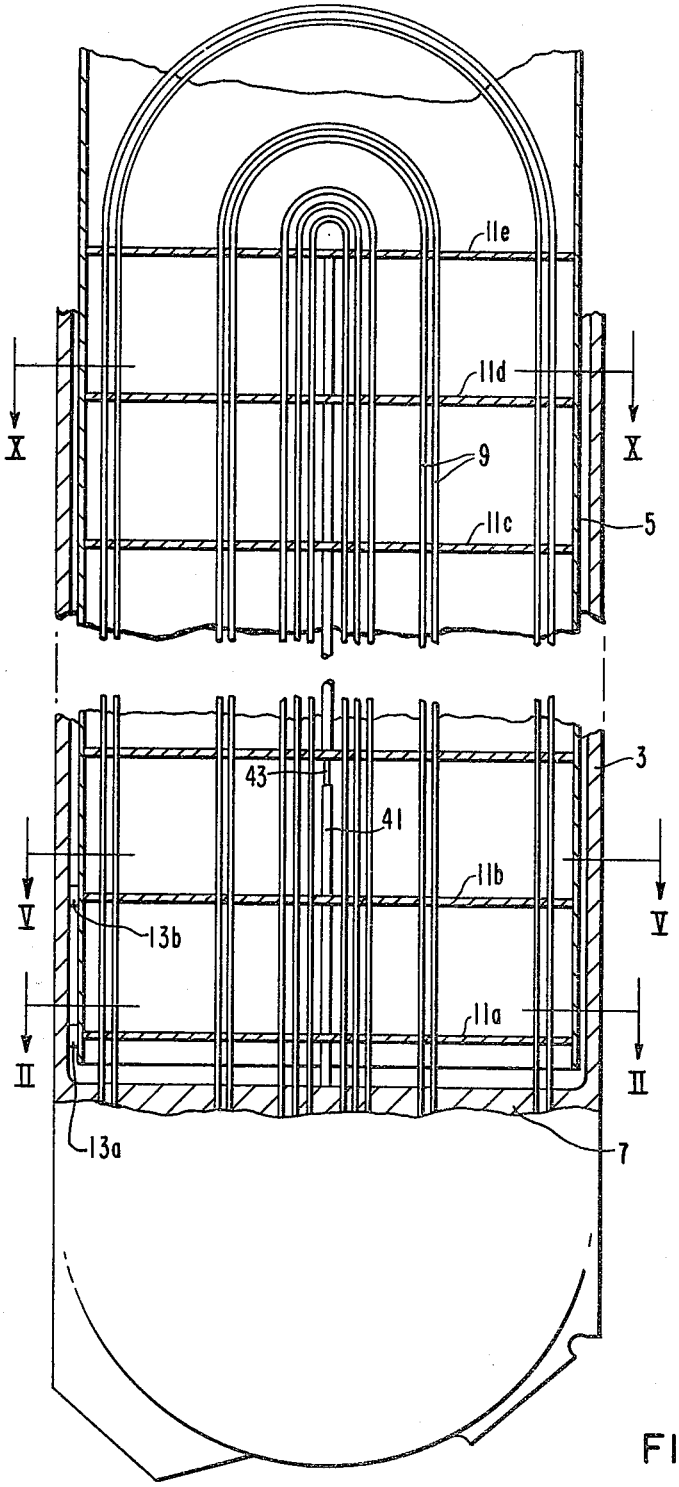
FIG. 1 is a partial sectional view of a steam generator made in accordance with this invention.

Referring now to the drawings in detail and in particular to FIG. 1, there is shown a portion of a steam generator or other heat exchanger 1 having a heavy wall, rolled and thus somewhat out-of-round, generally cylindrical shell portion 3; a thin wall, round, generally cylindrical wrapper portion 5 disposed within the shell portion and spaced therefrom. A tubesheet 7 having a plurality of holes for receiving tubes 9 and a plurality of generally parallel tube support plates or baffles 11 are longitudinally spaced within the wrapper portion and have a plurality of holes for receiving the tubes 9. At the location of the support plates 11 the wrapper 5 has an array of jacking members 13 affixed to the wrapper and disposed circumferentially therein. The jacking members for the various support plates are designated 13*a, b, c, d* and *e* to designate differently designed jacking members.

The tube support plates or baffles 11 are indicated as 11*a* through *h* as their distance from the tubesheet 7 increases.

Figure 2:
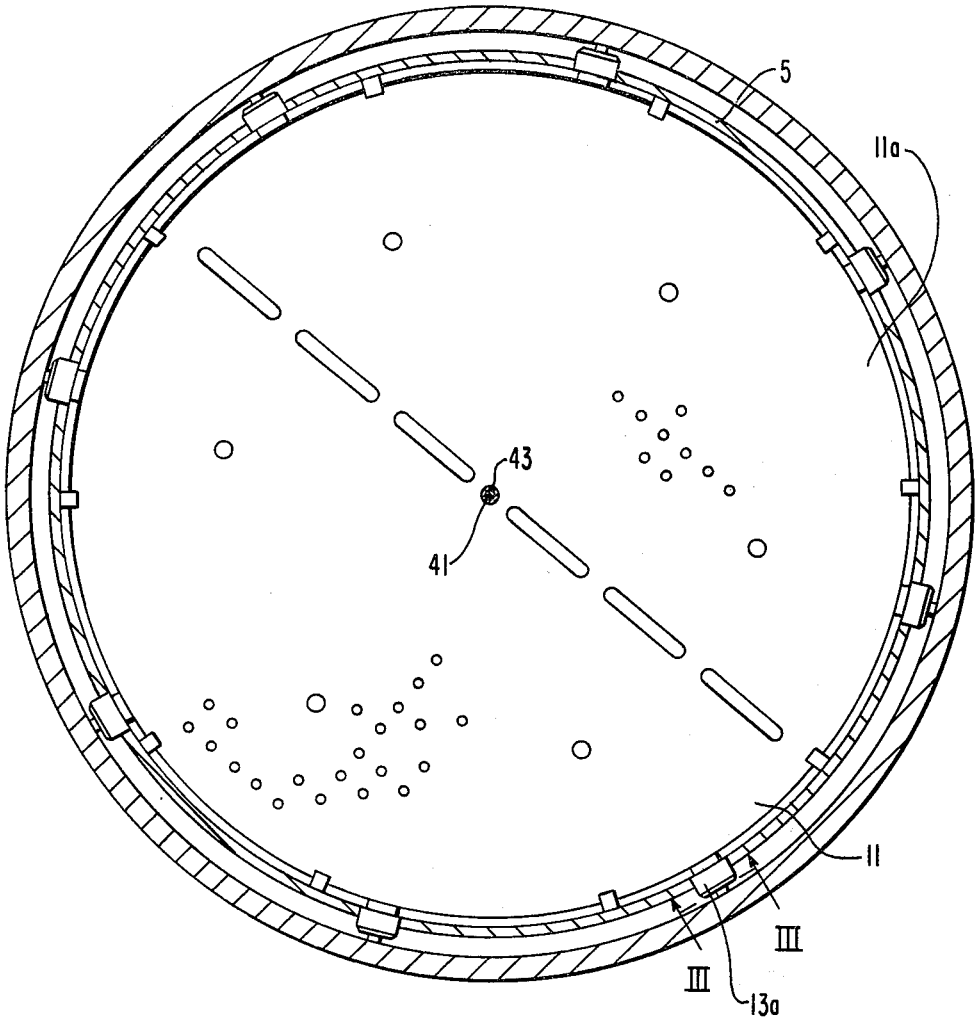
FIG. 2 is a sectional view taken on line II—II of FIG. 1.

The jacking members 13*a* as shown in FIGS. 2, 3 and 4 are disposed in the wrapper 5 adjacent the tube support plates 11*a* and comprise a thick disc or boss 15 affixed to the wrapper portion 5 by welding or other means and have an internally threaded hole 17 disposed therein. An externally threaded stud 19 screws into the hole 17 and is turned until it contacts the shell portion 3 and is then tightened one-half turn or 100 foot-pound of torque is applied to the stud in order to exert a predetermined force against the shell portion 3.

Figure 5:
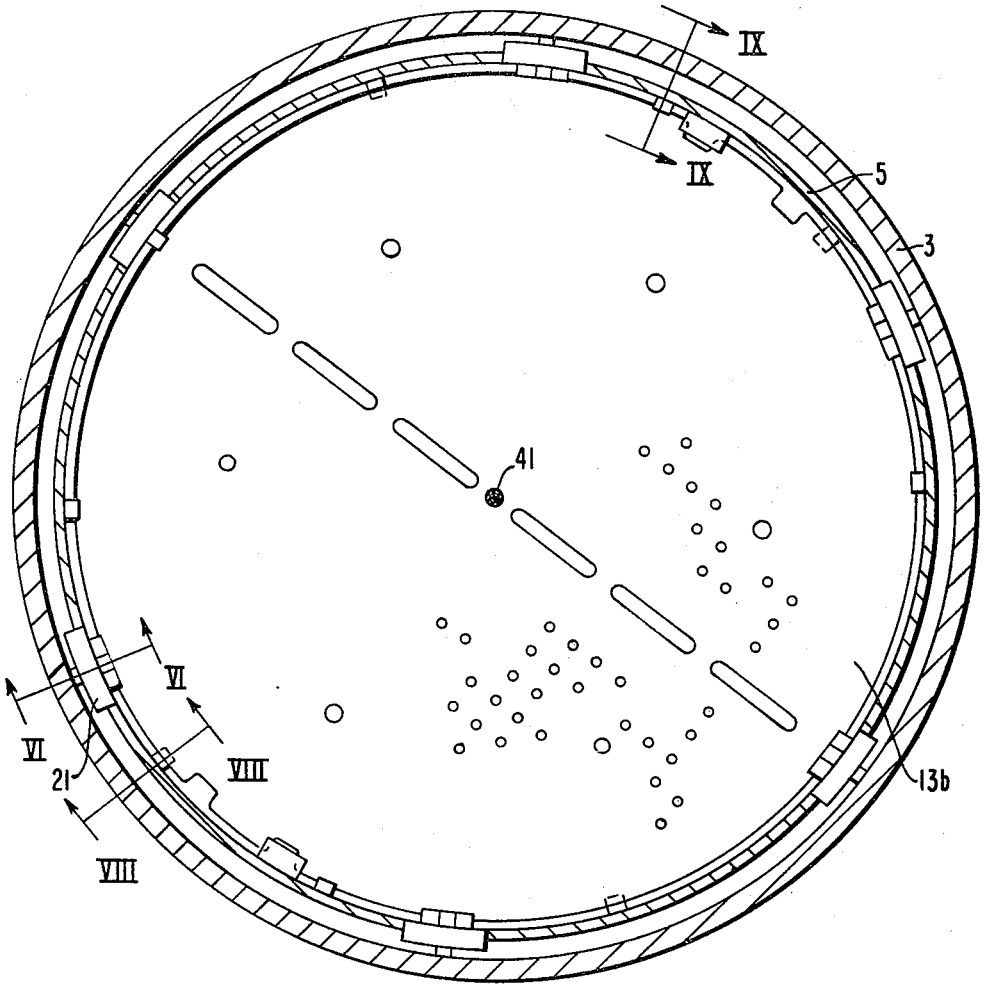
FIG. 5 is a sectional view taken on line V—V of FIG. 1.
Figure 6:
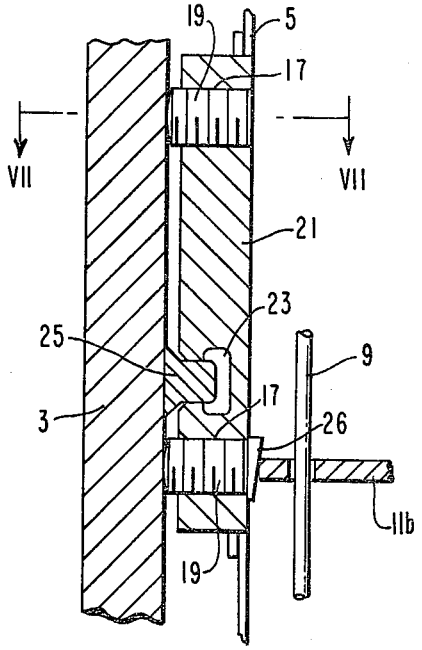
FIG. 6 is an enlarged sectional view taken on line VI—VI of FIG. 5.
Figure 7:
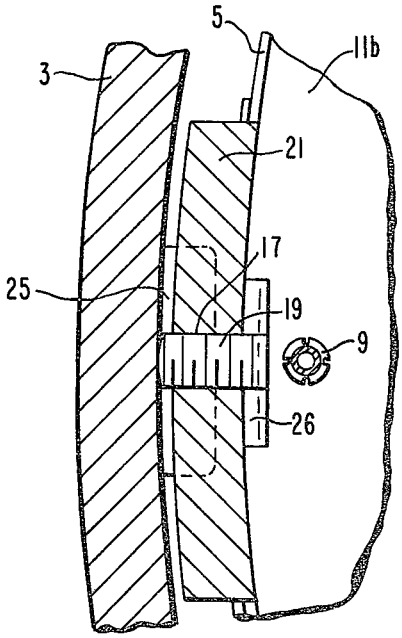
FIG. 7 is an enlarged sectional view taken on line VII—VII of FIG. 6.

The jacking member 13*b* is disposed in the wrapper 5 adjacent the tube support plate 11*b* and comprises a block 21 affixed to the wrapper portion 5 by welding or other means and has two internally threaded holes 17 disposed longitudinally or vertically within the block 21, or one above the other as shown in FIGS. 5, 6 and 7. The block 21 also has a circumferential or horizontal T-shaped groove 23 disposed therein. Threaded studs 19 screw into the hole 17 and contact the shell portion 3 and exert a predetermined force thereon. Lugs 25 are affixed to the shell portion 3 by welding or other means and are cooperatively associated with the grooves 23 in the block 21 to support the wrapper 5 within the shell and prevent longitudinal movement of the wrapper with respect to the shell at the location of the lugs 25.

Wedges 26 are utilized to position the support plate 11*b* within the wrapper 5.

Figure 11:
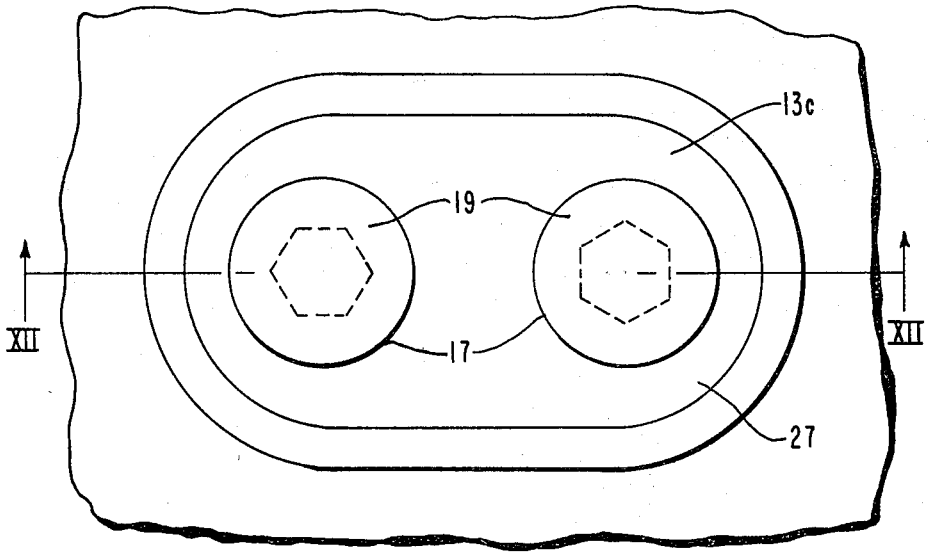
FIG. 11 is an enlarged sectional view taken on line XI—XI of FIG. 10.
Figure 12:
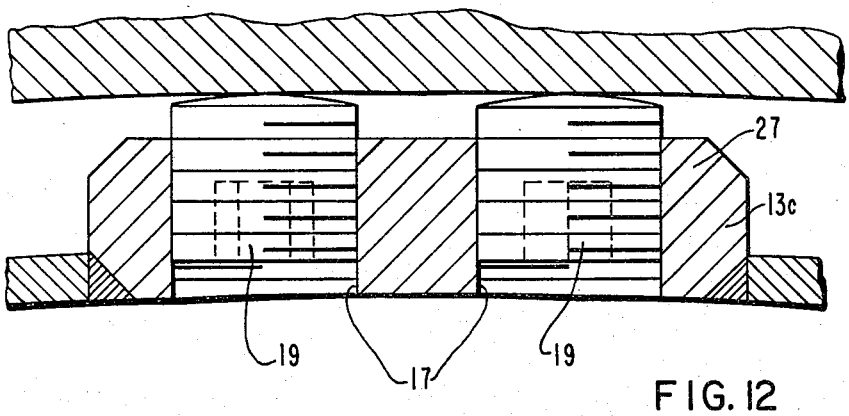
FIG. 12 is an enlarged sectional view taken on line XII—XII of FIG. 11.

The jacking members 13*c* as shown in FIGS. 11 and 12 are affixed to the wrapper 5 by welding or other means and comprise a thick oblong disc or boss 27 with two internally threaded holes 17 spaced horizontally or circumferentially in the boss. Externally threaded studs 19 screw into the holes 17 and contact the shell portion 3 to exert a predetermined force thereon. The jacking members 13*c* are disposed in a circular array adjacent the tube support plate 11*e*.

Alternatively, as shown in FIG. 14 a thick ring 29 could serve as a jacking member 13*d*. The ring 29 is affixed to the wrapper 5 by welding or other means and has a plurality of internally threaded holes 17 disposed circumferentially around the ring 29. The holes may be longitudinally spaced one above the other or in a staggered arrangement. Externally threaded studs 19 screw into the holes 17 and engage the shell 3 with a predetermined force.

Jacking member 13*e* as shown in FIG. 13 comprises a block 31 affixed to the wrapper portion 5 by welding or other means and has two internally threaded holes 17 circumferentially or horizontally spaced therein. Externally threaded studs 19 screw into the holes 17 and contact the shell portion 3 exerting a predetermined force thereon. The blocks 31 also have a vertically or longitudinally oriented T-shaped groove 33 disposed therein. Lugs 35 are affixed to the shell portion 3 and cooperate with the grooves 33 to prevent rotation of the wrapper 5 relative to the shell 3 adjacent the lugs 35.

Figure 8:
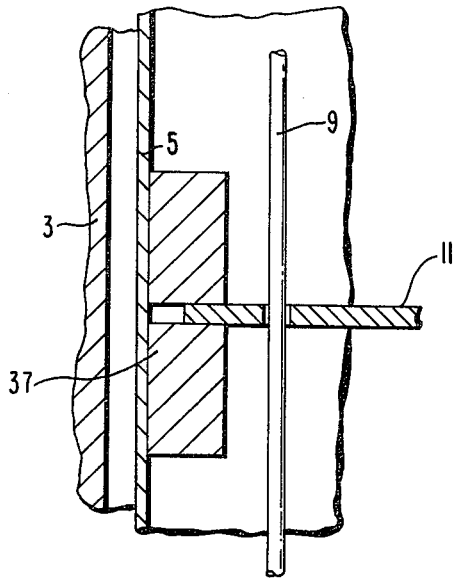
FIG. 8 is an enlarged sectional view taken on line VIII—VIII of FIG. 5.

As shown in FIG. 8, brackets 37 are affixed to the wrapper portion 5 by welding or other means to support the edge or outer periphery of the tube support plates 11.

Stay rods 41 and sleeves 43 are utilized to support the central portion of the tube support plate 11 as shown in FIG. 1.

Figure 9:
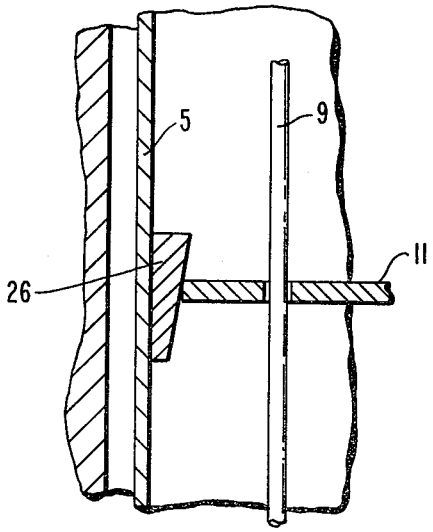
FIG. 9 is an enlarged sectional view taken on line IX—IX of FIG. 5.
Figure 10:
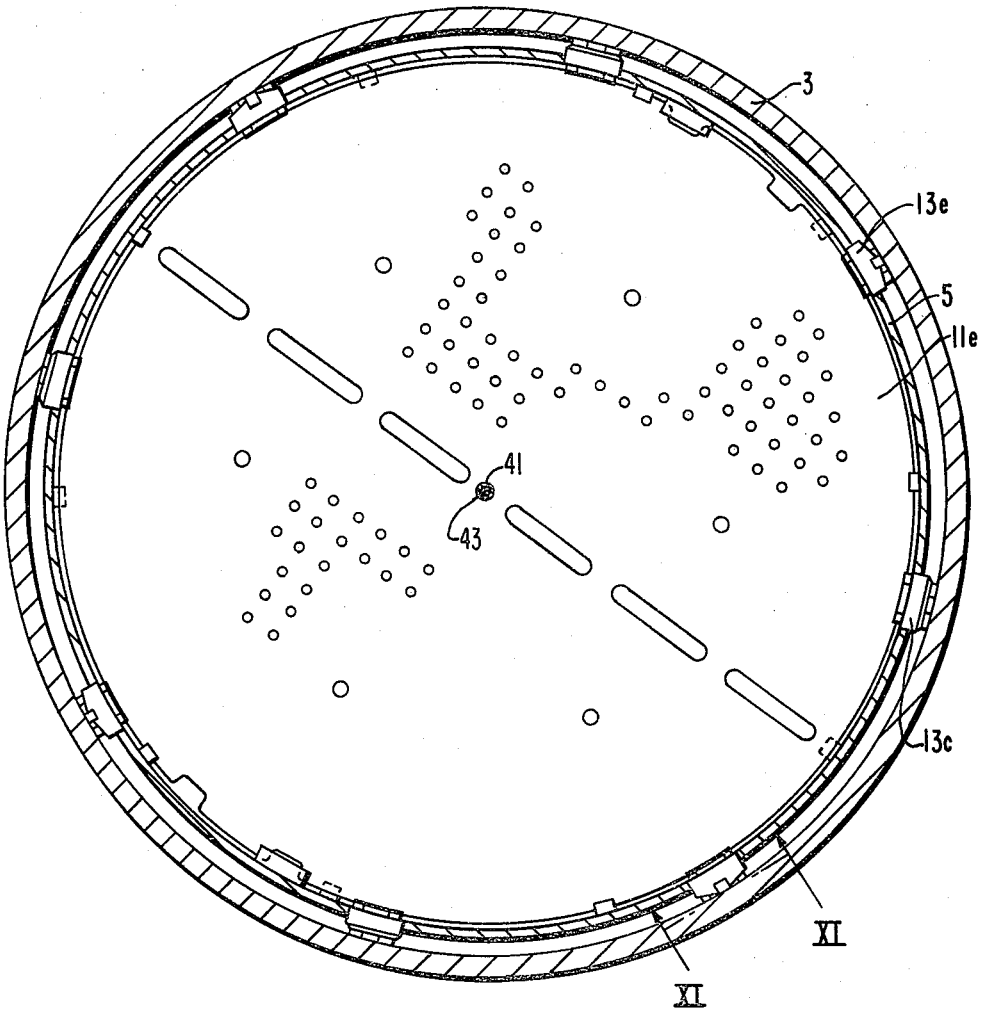
FIG. 10 is a sectional view taken on line X—X of FIG. 1.

As shown in FIG. 9 to locate the round tube support plates 11 within the round wrapper 5, a plurality of wedges 26 are placed around the perimeter or periphery of the tube support plate 11 spacing the tube support plate 11 and aligning the tube holes in the tube support plate 11 with holes in the tubesheet 7 utilizing a laser or optical alignment means, or elongated fitted rods or other mechanical alignment means.

The wedges 26 are welded in place to maintain the spacing, to prevent them from moving, and to maintain a minimum annular clearance all the way around the support plate 11 as the wrapper 5 grows due to thermal expansion.

To install the thin wall, round cylindrical wrapper 5 in the heavy wall, rolled and slightly out-of-round shell 3, stiff round rings are temporarily placed inside the wrapper 5 so that it is maintained in its round shape while being handled and as it is inserted into the shell. Once the lugs and blocks are installed and the studs 19 are screwed outwardly to engage the shell with a predetermined amount of force, the rings can be removed. The tube support plates are initially installed adjacent the tubesheet and added successively from 11*a* to 11*e*.

The jacking members with greater number of studs are utilized in the upper portion of the shell 3 or in that portion which is a greater distance from the tubesheet 7 in order to withstand seismographic and other shock loads to which the heat exchanger could be subjected.

What is claimed is:

1. A heat exchanger comprising a tubesheet with a plurality of holes for receiving tubes;

a heavy wall rolled cylindrical shell portion attached to the tubesheet;

a thin wall round wrapper portion disposed within said shell portion and spaced therefrom;

a plurality of generally parallel tube support plates longitudinally spaced within said wrapper portion and having a plurality of holes for receiving tubes;

jacking members disposed circumferentially about said wrapper portion adjacent the location of said support plates, said jacking members extending radially outwardly from said wrapper portion into engagement with said shell portion;

a first array of lugs affixed to said shell portion;

a first array of blocks affixed to said wrapper;

said first array of lugs and blocks being cooperatively associated to prevent longitudinal movement of said wrapper portion with respect to said shell portion adjacent said first array of lugs;

a second array of lugs affixed to said shell;

a second array of blocks affixed to said wrapper;

said second array of lugs and blocks being cooperatively associated to prevent relative rotation of said shell portion with respect to said wrapper portion adjacent said second array of lugs;

wedges disposed between said wrapper portion and said tube support plates; and means for preventing rotation of said tube support plate with respect to said wrapper, whereby said holes in said tube support sheets can be aligned with said holes in said tubesheet and the support plate can be accurately spaced within the wrapper portion to provide a controlled annular space therebetween.

2. A heat exchanger as set forth in claim 1, wherein the first array of blocks have circumferentially oriented grooves.

3. A heat exchanger as set forth in claim 1, wherein the second array of blocks have longitudinally oriented grooves.

4. A heat exchanger as set forth in claim 1, wherein the jacking members comprise bosses, each having an internally threaded hole and an externally threaded stud which screws therein.

5. A heat exchanger as set forth in claim 4, wherein the jacking members further comprise oblong bosses, each having a plurality of internally threaded holes and a plurality of externally threaded studs which screw therein.

6. A heat exchanger as set forth in claim 4, wherein the jacking members further comprise a heavy walled ring with a plurality of internally threaded holes and externally threaded studs which screw therein.

7. A heat exchanger as set forth in claim 4, wherein the means for preventing rotation of the said tube support plate with respect to said wrapper comprises keyways disposed in the outer periphery of said tube support plates and keys affixed to said wrapper.

8. A heat exchanger as set forth in claim 5, wherein the means for preventing rotation of said tube support plate with respect to said wrapper comprises keyways disposed in the outer periphery of said tube support plates and keys affixed to said wrapper.

9. A method of installing a thin wall, round cylindrical wrapper inside an out-of-round heavy wall shell of a heat exchanger having a plurality of generally parallel longitudinally spaced tube support plates with holes that align with holes in a tube support sheet; said method comprising the steps of:

placing temporary round rings within the wrapper in the vicinity of the support plates;

affixing a circumferential array of jacking members operable from the inside of the wrapper to the wrapper;

operating said jacking members so that they engage the shell with a predetermined force;

removing said temporary round ring from said wrapper;

affixing a first array of lugs to said shell;

affixing a first array of blocks to said wrapper;

providing full operation between said first array of lugs and blocks to prevent longitudinal movement of said wrapper with respect to said shell adjacent said first array of lugs;

affixing a second array of lugs to said shell;

affixing a second array of blocks to said wrapper;

providing cooperation between said second array of lugs and blocks to prevent rotation of said wrapper with respect to said shell adjacent the second array of lugs;

placing said tube support plates in said wrapper in the vicinity of said jacking members;

placing wedges between the wrapper and the support plates to space the support plates a given distance from the wrapper;

supporting the support plates from the periphery by brackets extending from the wrapper;

keying the support plates to the wrapper to prevent rotation therebetween.

10. The method as set forth in claim 9 and further comprising the step of providing substantially more contact between the jacking members and the shell at one end of the wrapper than at the other.

* * * * *